US005441085A

United States Patent [19]

Hunziker et al.

[11] Patent Number: 5,441,085

[45] Date of Patent: Aug. 15, 1995

[54] WARP THREAD INSERTION DEVICE FOR SERIES-SHED LOOMS

[75] Inventors: Andreas Hunziker, Nänikon; Rudolf Frischknecht, Rüti, both of Switzerland

[73] Assignee: Sulzer Rueti AG, Rueti, Switzerland

[21] Appl. No.: 154,835

[22] Filed: Nov. 19, 1993

[30] Foreign Application Priority Data

Feb. 26, 1993 [EP] European Pat. Off. ..... 93810141.7

[51] Int. Cl.[6] ..... D03D 41/00

[52] U.S. Cl. ..... 139/28; 139/11

[58] Field of Search ..... 139/28, 11, 30, 29

[56] References Cited

U.S. PATENT DOCUMENTS

| | | | |
|---|---|---|---|
| 4,291,729 | 9/1981 | Steiner | 139/28 |
| 4,498,501 | 2/1985 | Steiner | 139/28 |
| 4,531,553 | 7/1985 | Steiner | 139/28 |
| 5,188,154 | 2/1993 | Christe et al. | 139/28 |

FOREIGN PATENT DOCUMENTS

| | | |
|---|---|---|
| 0093078 | 11/1983 | European Pat. Off. . |
| 0154148 | 9/1985 | European Pat. Off. . |

*Primary Examiner*—Andrew M. Falik

*Attorney, Agent, or Firm*—Townsend and Townsend Khourie and Crew

[57] ABSTRACT

An insertion device for a series-shed loom having a rotor including combs (2) and shedding members for guiding the warp threads (3) over a predetermined angular region for shedding. The insertion device has a laying bar (10) with recesses (24) to guide the warp thread (3). It is moved to and fro parallel to the rotor by a drive mechanism for inserting the warp threads (3) into the shedding members on the rotor. Each laying bar (10) is associated with a guide bar (25) for deflecting the warp thread (3) for aligning it with the recess (24) in the laying bar (10). As a result the laying bar (10) is advantageously relieved of most of the warp thread tension and only directs the warp just parallel to the rotor. The laying bar (10) may consequently have a low mass.

8 Claims, 6 Drawing Sheets

WARP THREAD INSERTION DEVICE FOR SERIES-SHED LOOMS

BACKGROUND OF THE INVENTION

The invention relates to an insertion device for a series-shed loom with a rotor which is covered with combs and shedding members and at which warp threads are guided over a predetermined angular region for shedding. The device has laying bars provided with recesses for guiding the warp threads, and which can be displaced parallel to the axis of rotation of the rotor for the insertion of the warp threads into shedding high and low points. A drive mechanism moves the laying bars back and forth and inserts the warp threads into the shedding points.

In European Patent Specification EP 0 093 078 laying components are shown in the form of toothed racks, which are attached to support stands, which in turn are slidably mounted along the rotor in support members in order to perform a laying movement. Devices of this type are relatively heavy and the movable masses are accelerated and braked for each movement. Furthermore, friction caused by the stroke length produces efficiency loss, frictional heat and abrasion and the laying bars have to be given relatively large cross sections so that the traction of the warp threads does not result in too great strain and deformation respectively.

SUMMARY OF THE INVENTION

It is an object of the invention to create an insertion device which eliminates these disadvantages by dividing the insertion operation into a deflection and insertion operation.

This object is achieved in accordance with the invention by associating each laying bar with a fixed guide bar which deflects the warp thread to be inserted and aligns it with the recess, guiding the warp thread in the laying bar.

The advantages of the invention are essentially regarded as being that the loading of the laying bar by the warp threads is substantially reduced, that the laying bars can have a light-weight design over large loom widths and therefore have a low mass, and that a high insertion speed is attained.

DESCRIPTION OF THE PREFERRED EMBODIMENTS

Figure 1:
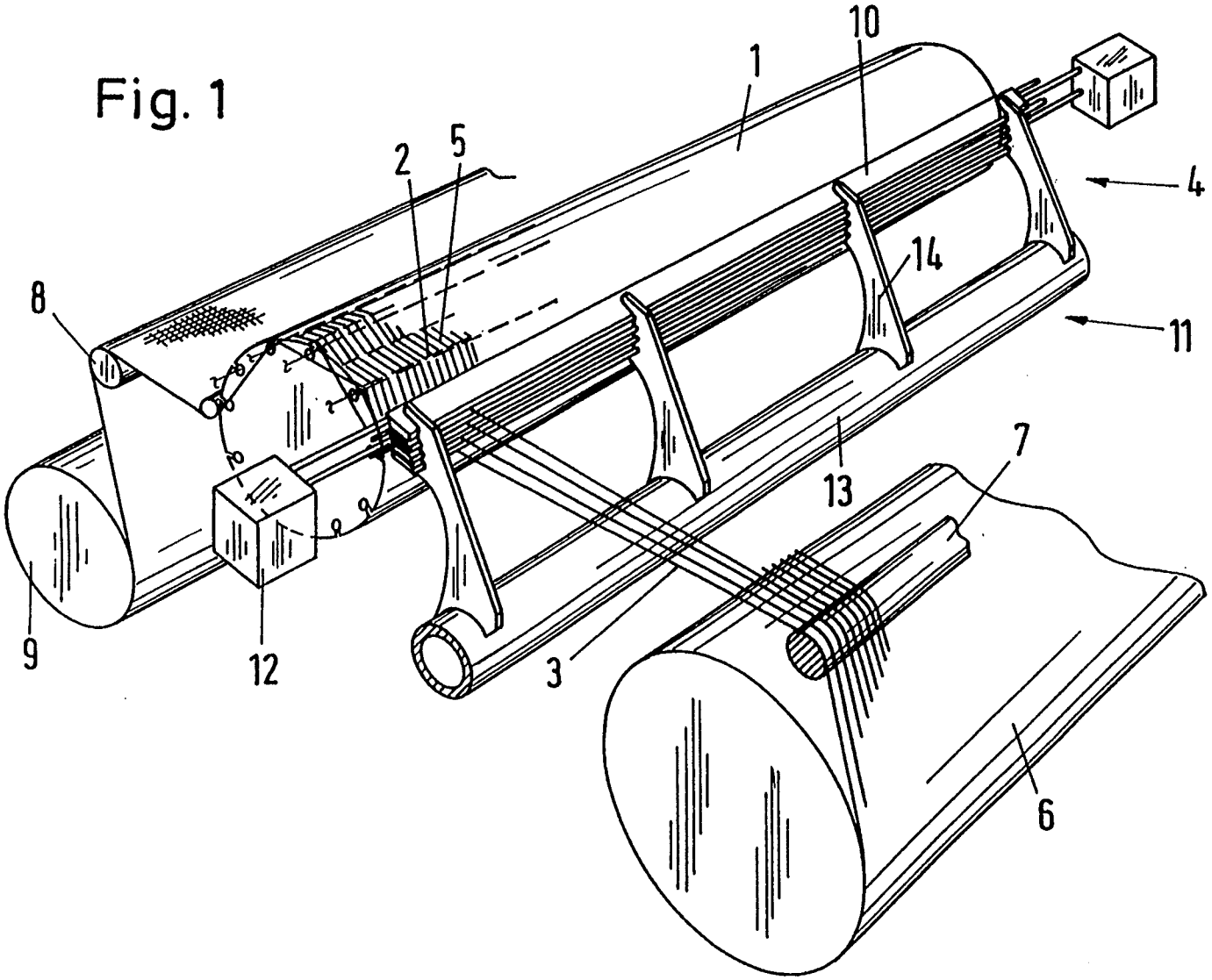
FIG. 1 is a diagrammatical representation of a series-shed loom having an insertion device according to the invention with several laying bars.

FIG. 1 shows a series-shed loom having a rotor 1, which is provided with combs 2 and on which the warp threads 3 are guided over an angular region for shedding. The combs 2 are equally spaced in the longitudinal direction of the axis of rotor such that equidistant gaps 5 are formed. The series-shed loom further has an insertion device 4 for inserting the warp threads into the gaps 5.

The insertion device under discussion has a number of laying bars 10, a retention device 11 for the laying bars 10 and a drive mechanism 12 drivingly connected with the laying bar 10. The laying bars 10 are held at a distance from the rotor 1 and parallel to the longitudinal direction of rotor axis by means of the retention device 11. The retention device 11 extends over the length of the rotor. The drive mechanism 12 moves the laying bars 10 parallel to and in the longitudinal direction of the rotor axis such that the warp threads 3 are shifted with regard to the equidistant gaps 5 by the laying bars to insert the warp threads according to a program into predetermined gaps 5 between the combs which rotate past the laying bars.

The laying bars 10 are retained in a retention device 11, which includes a support 13 disposed parallel to the rotor axis, a number of clamps 14 which are spaced with respect to one another and are oriented in the same direction, and which ire securely connected to the support 13, and guide bars securely connected to the clamps 14, which bars have at least the same length as the rotor 1 and respectively cover at least the warp drafting width.

Figure 2:
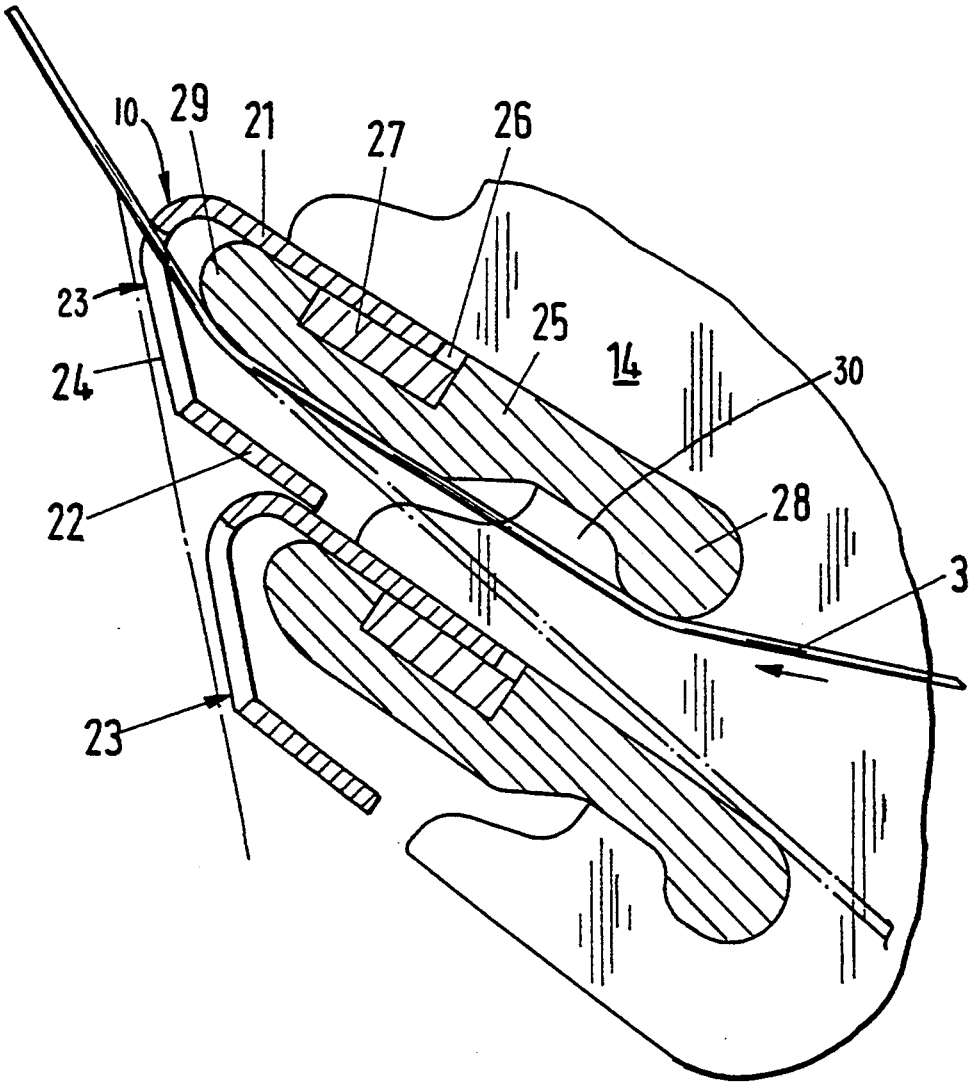
FIG. 2 is a cross section of a first embodiment of a laying bar arrangement according to the invention.

FIG. 2 shows a cross section of a preferred embodiment of an arrangement of the laying bar 10. The laying bar 10 consists of a sheet metal section having two portions 21, 22 extending parallel to one another, which have different lengths, and a connecting portion 23 which extends between and is inclined with respect to the portions 21, 22 and which connects the portions to each other. In the connecting portion 23 are disposed recesses 24 for guiding the warp threads 3, the design of which will be described later.

Each laying bar 10 is associated with a guide bar 25. The laying bar 10 is slidably mounted on the guide bar 25. For this purpose a recess 26 is provided on the upper side of the guide bar 25, which extends in the longitudinal direction of the guide bar over its length. The laying bar 10 is provided with a strip-shaped guide member 27, which is attached by suitable means, e.g. by spot welding, to the inside of the long portion 21.

The laying bar 10 is slidably mounted in recess 26 of the guide bar so that it can be moved backwards and forwards in the longitudinal direction of the guide bar 25. A portion of the clamp 14 retains the laying bar in the guide bar recess and prevents it from being lifted out of it.

First and second rounded portions 28, 29 at respective ends of the narrow sides of the guide bar 25 deflect the warp thread 3 to be inserted. Guide bar 25 has a groove-shaped recess 30, on the under side of the guide bar to prevent warp threads becoming clamped between the guide bar and clamp 14.

Figure 3:
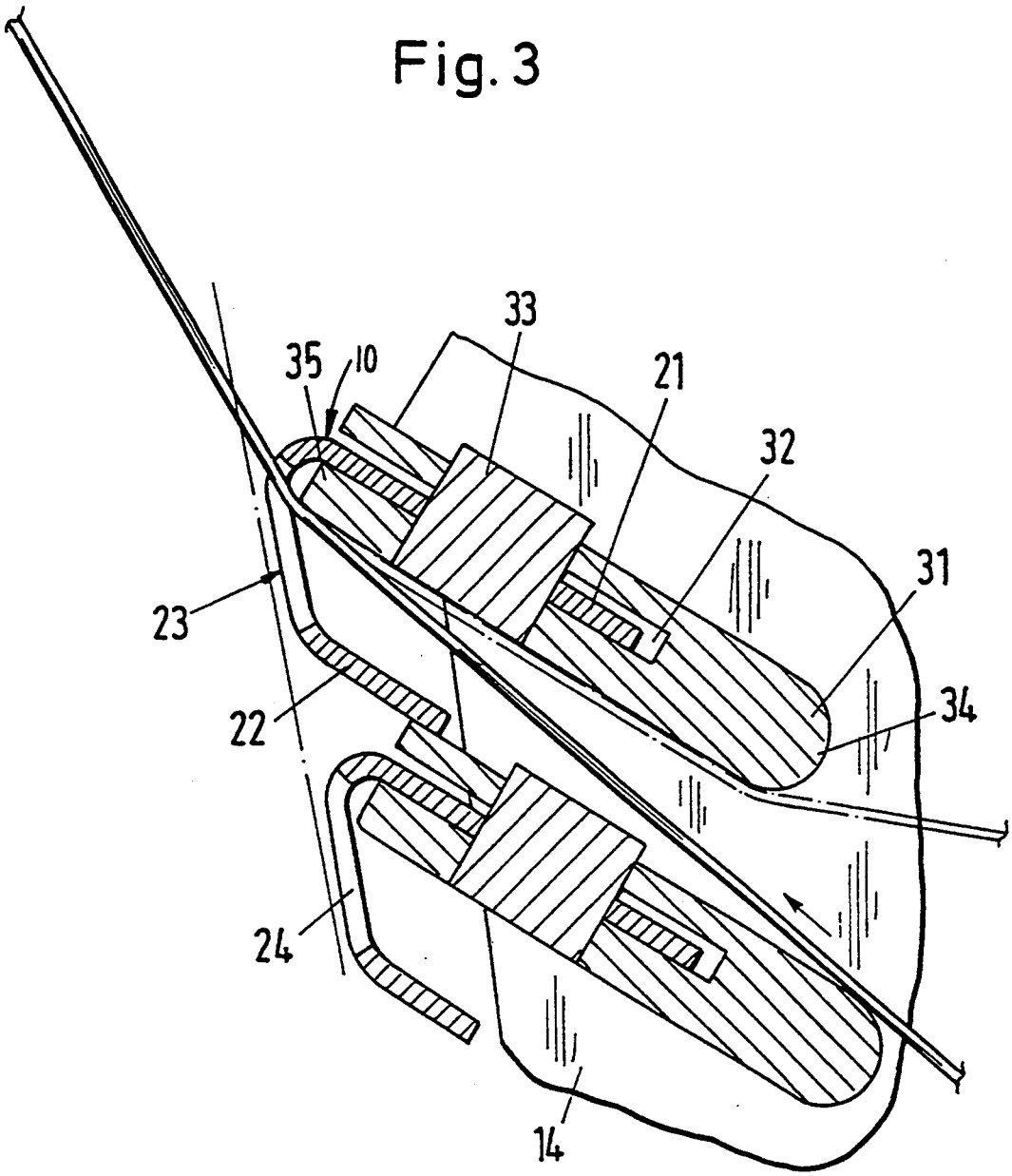
FIG. 3 is a cross section of a second embodiment of a laying bar arrangement according to the invention.

Another embodiment of the arrangement of the laying bar 10 is represented in FIG. 3. In this embodiment the laying bar 10 is made from the same sheet metal profile as in the embodiment previously described. The guide bar 31 has a substantially rectangular cross section and comprises a slit-shaped recess 32, which commences at a narrow side of the bar and extends parallel to the side faces. Recess 32 extends in the longitudinal direction over the length of the guide bar. Appropriately spaced guide blocks 33 guide the laying bar 10.

For this purpose a slot is formed in the long portion 21 of the sheet metal profile. It is dimensioned so that the laying bar 10 can be moved along the guide bar backwards and forwards over a predetermined length in the longitudinal direction of the guide bar.

At the narrow sides the guide bar 31 comprises first and second rounded portions 34, 35 in order to deflect the warp thread 3 to be inserted. The guide bar 31 can also have a groove-shaped recess just like the guide bar 25 in the first embodiment.

In both embodiments the guide bars 25 and 31 respectively are disposed in the clamp 14 so that the end portion of the short portion 22 of the laying bar 10 is disposed at a predetermined distance with respect to the long portion 21 of the adjacent laying bar 10. With this arrangement the excursion of the connecting portion 23 with respect to the rotor 1 is prevented in a particularly advantageous manner, if there is a knot in the warp thread 3.

Figure 4:
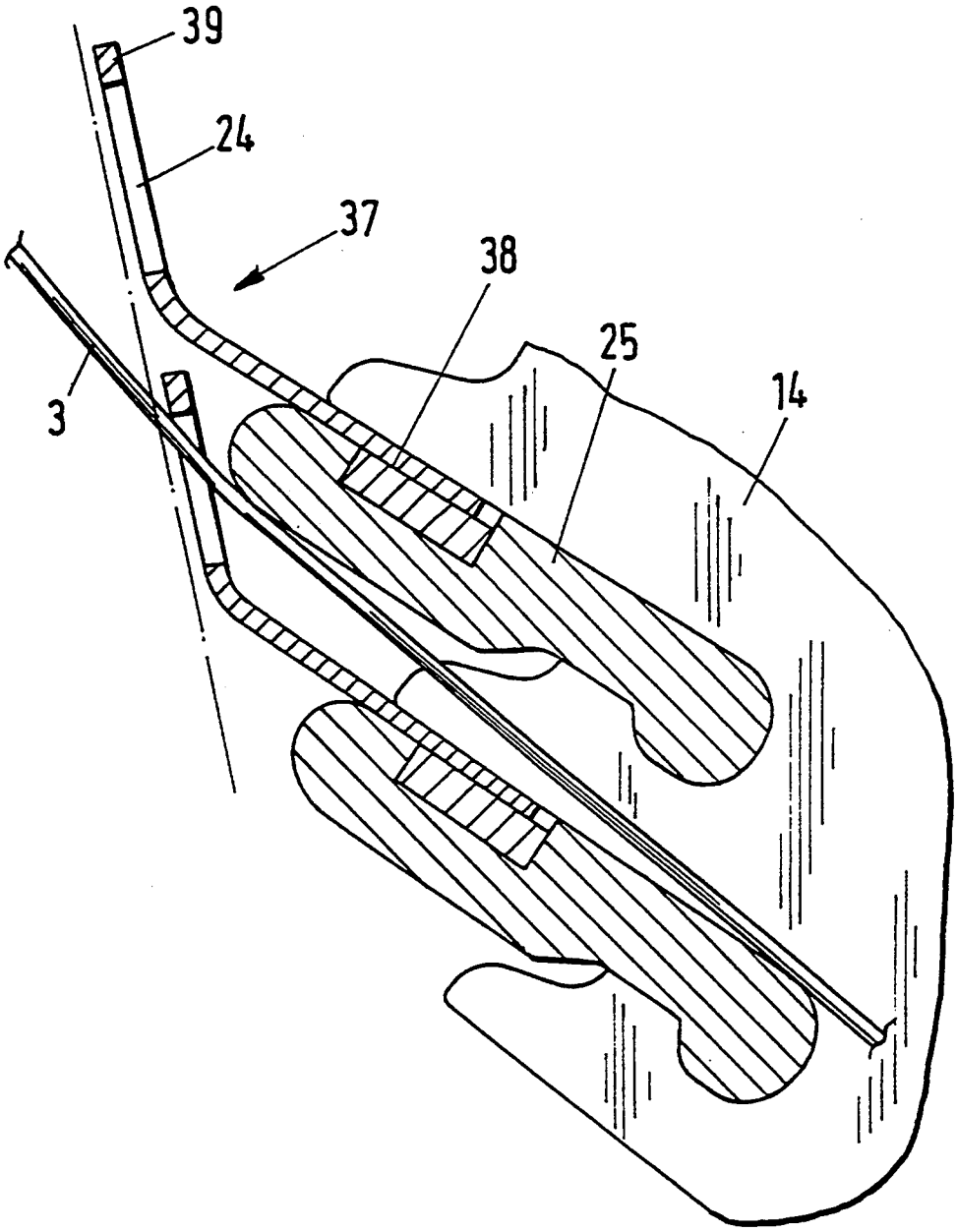
FIG. 4 is a cross section of a third embodiment of a laying bar arrangement according to the invention.

FIG. 4 shows a further embodiment of the arrangement of the laying bar.

In this embodiment the laying bar 37 consists of a substantially L-shaped sheet metal profile having a long limb 38, which is connected to the guide bar 25, and having a short limb 39, in which the recesses 24 for guiding the warp threads 3 are constructed. It is pointed out that this laying bar 37 can also be used in an arrangement shown in FIG. 3.

Figure 5:
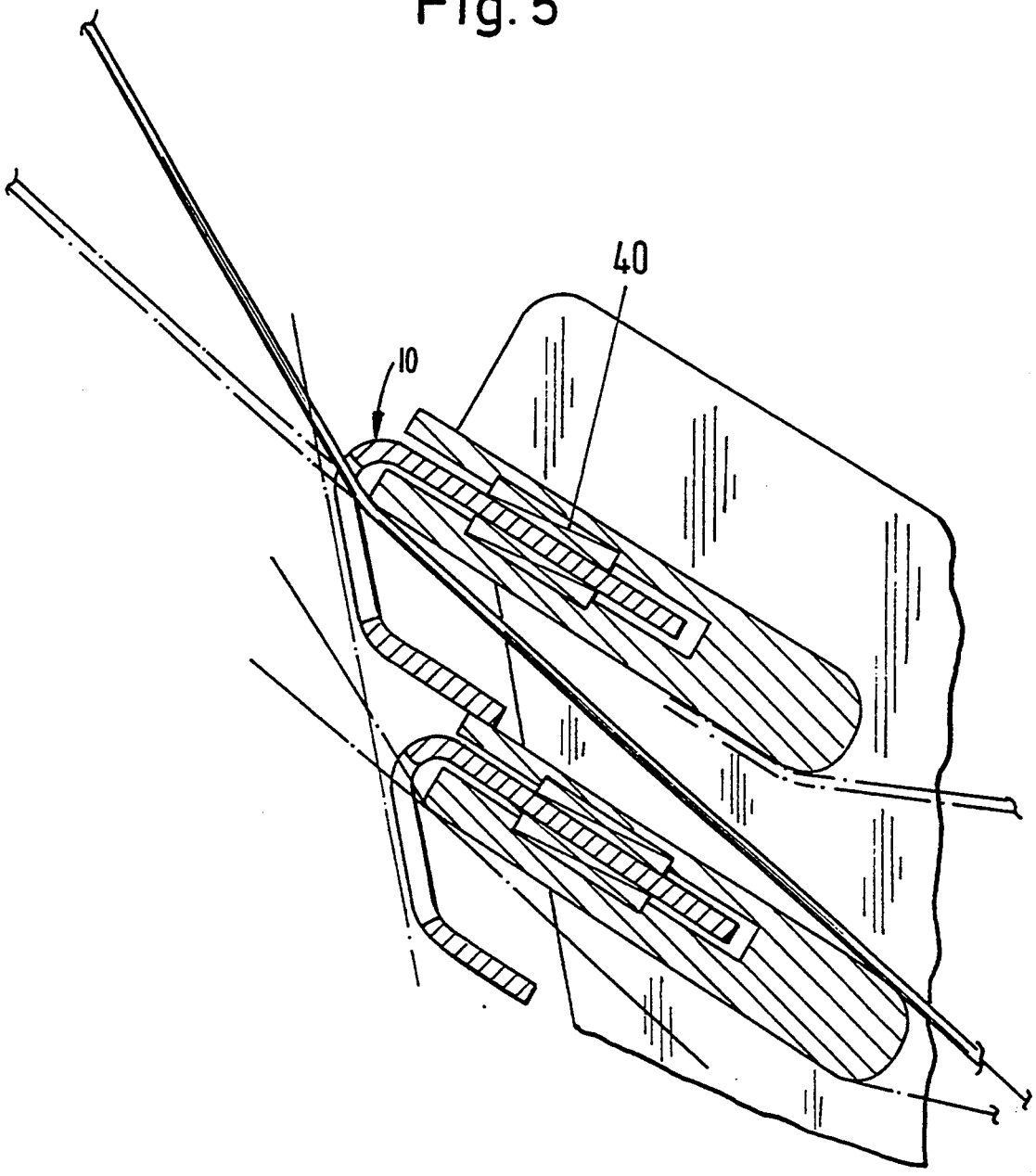
FIG. 5 is a modification of the laying bar arrangement represented in FIG. 3 and FIGS. 6*a*–6*e* show different embodiments of recesses according to the invention for guiding the warp threads.

As FIG. 5 shows, laying bar 10 can also be mounted by means of rolling members 40 instead of in a sliding manner.

In FIGS. 2 to 4 are represented examples of paths of the warp threads in order to explain the function of the laying bar arrangement.

As can be seen from FIGS. 2 and 3, the warp threads 3 to be inserted are deflected twice. These deflections are performed either on one and the same guide bar 25 (FIG. 2) or on two adjacent guide bars 31 (FIG. 3) and in fact at the first and second rounded portion 28, 29 and respectively 34, 35 provided for this purpose. The first deflection of the warp thread 3 at the first portion 28 or respectively 34 is provided for the thread feed and is used for the preliminary alignment of the warp thread 3 to be inserted with the recess 24 in the laying bar 10. The second deflection of the warp thread 3 at the second portion 29, or 35 respectively, is provided for shedding purposes and forms the bearing point aligned with recess 24 in laying bar 10 for the excursion of the warp thread parallel to the rotor axis during insertion into the shedding high and low points in a direction perpendicular to the rotor axis. Thus laying bar 10 is largely relieved of the warp thread tension, and only directs the warp thread 3 to be inserted during movements parallel to the rotor axis. From the above it is evident that the laying bar 10 can advantageously be constructed with a low mass, which in turn has an advantageous effect on the insertion speed.

FIGS. 6*a* to 6*e* show contours of the recesses 24 intended to guide the warp 3, which are constructed lying in a row in the connecting portion 23 of the laying bar 10.

Figure 6A:
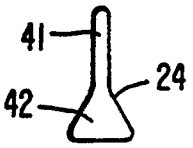
Figure 6B:
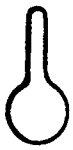
Figure 6C:
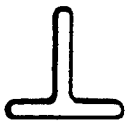
Figure 6D:
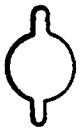
Figure 6E:
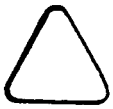

The preferred embodiment of the recess 24 is represented in FIG. 6*a*. This recess comprises a slit-shaped portion 41, into which the warp 3 to be inserted is guided during the insertion operation, and an widened portion 42 adjoining it, which is intended to draw the warp thread into the recess by means of a suitable tool, e.g. a needle, and to receive the relieved warp thread when the warp thread is relieved, e.g. in the event of a warp thread and/or weft thread error.

A recess in the form of a slot may also be provided instead of the contours represented in FIGS. 6*a* to 6*e*.

What is claimed is:

1. An insertion device for a series-shed loom having a rotor including combs and shedding members for guiding warp threads over a predetermined angular region for shedding, the device comprising a number of laying bars each provided with a recess for guiding the warp threads and each being displaceable parallel to the axis of rotation of the rotor for the insertion of the warp threads into shedding high and low points, a drive mechanism for moving the laying bars to and fro in the direction of the rotor axis for inserting the warp threads according to a program into the shedding points, and a fixed guide bar associated with each laying bar, the fixed guide bar being formed to deflect the warp thread to be inserted for alignment with the recess in the laying bar.

2. A device according to claim 1, wherein the laying bar comprises a substantially L-shaped profile including a connecting portion, and wherein the recess is constructed in the connecting portion.

3. A device according to claim 1, wherein the laying bar comprises a substantially L-shaped section including a short limb, and wherein the recess is constructed in the short limb.

4. A device according to claim 1, wherein the laying bar is disposed on the guide bar and includes a portion comprising the recess which is adapted to be turned towards the rotor.

5. A device according to claim 4, wherein the laying bar is adapted to be slidably mounted on the guide bar.

6. A device according to claim 4, including rolling members mounting the laying bar on the guide bar.

7. A device according to claim 1, wherein the guide bar comprises at least one portion for deflecting the warp thread.

8. A device according to claim 7, wherein the guide bar comprises first and second portions for deflecting the warp thread.

* * * * *